US006149082A

United States Patent [19]

Von Lindenberg

[11] Patent Number: 6,149,082

[45] Date of Patent: Nov. 21, 2000

[54] PAPER WASTE DISPOSAL SYSTEM

[76] Inventor: Mike Von Lindenberg, 343 SW. 29th Rd., Miami, Fla. 33129

[21] Appl. No.: 09/188,754

[22] Filed: Nov. 9, 1998

[51] Int. Cl.[7] ..... B02C 19/12

[52] U.S. Cl. ..... 241/60; 241/101.2; 241/101.3

[58] Field of Search ..... 100/97, 96, 99; 241/101.3, 236, 57, 60, 62, 101.2

[56] References Cited

U.S. PATENT DOCUMENTS

| | | | |
|---|---|---|---|
| 3,636,864 | 1/1972 | Loscialo | 100/97 |
| 3,685,437 | 8/1972 | Panning | 100/97 |
| 5,873,304 | 2/1999 | Ruf | 100/97 |

*Primary Examiner*—Mark Rosenbaum
*Attorney, Agent, or Firm*—Malloy & Malloy, P.A.

[57] ABSTRACT

A paper waste disposal system having an intake assembly structured to receive paper waste generated by a continuous feed and operation printing system, a collection assembly structured to collect and contain the paper waste received by the intake assembly, and a disposal moderation assembly structured to continuously pass the paper waste received by the intake assembly to the collection assembly and to control a rate of the continuous passage thereof into the collection assembly so as permit removal of the paper waste contained by the collection assembly without requiring an interruption in the receipt of the paper waste by the intake assembly and accordingly the operation of the printing system.

27 Claims, 4 Drawing Sheets

PAPER WASTE DISPOSAL SYSTEM

BACKGROUND OF THE INVENTION

1. Field of the Invention

The present invention relates to a paper waste disposal system particularly suited for use with continuous feed/continuous operation printing system wherein a shut-down of the printing is not desirable, however, an efficient and effective removal of various types of paper waste, including, paper trim, paper chad and dust, generated thereby is required.

2. Description of the Related Art

Despite the increasing popularity of digital and other electronic medium, the need to generate large quantities of paper documents continues to be great. Indeed, this need is actually increasing as a result of the popularity of the electronic media due to the increased rate of transactions and the relative ease with which printed records, confirmations and documents can be prepared, generated and forwarded. Accordingly, a large majority of the paper documents generated are derived from computer systems, and as a result, are created by printing system associated with the computer system.

Even though many printing jobs are associated with a single or a relatively small number of tasks, in many business environments, very large volumes of paper documents are frequently generated, often on a continuous basis. In these businesses, fast and powerful printers are utilized to generate a very large volumes of documents, often at an incredibly rapid rate, and in a continuous manner. Although in some instances individual sheets of paper may be utilized for the heavy duty printing system, the more common situation incorporates the use of linked or continuous paper streams, which can be separated subsequent to printing, thus ensuring a longer continuous feed of paper during printing. The most common types of continuous paper streams include roll feed paper and fan fold paper. Further, these types of continuous paper streams in many instances provide for substantially extended periods of use and/or the end to end joining of numerous paper supplies to ensure that substantially continuous printing is maintained without the need to interrupt the printing in order to add more paper to a printing bin.

The most common type of continuous feed or linked paper structure includes a track structure disposed on the opposite edges of the paper so as to facilitate the feeding of the paper through the printing system. Naturally, however, while the track structure is beneficial for passing the paper continuously through the printing system, the track structure also needs to be discarded, as it is not a part of the final paper document generated. The track structure typically utilized with continuous feed paper streams is generally comprised along opposite side edges of the paper. Furthermore, this track typically includes a series of holes defined along the edges of the paper and into which a toothed gear structure can be engaged to pull the paper through the printer. These holes are typically generated by the removal of a series of perforated paper segments, typically referred to as paper chad, which are essentially punched out of the paper trim, and often can remain with the paper as it is fed through the printing system. This paper chad, accordingly, provides a paper waste component which must be discarded. More significantly, however, once the printing has been completed, the individual paper sheets are separated from one another, including the removal of any perforations that may be present therebetween, and the track is removed from the side edges of the paper, thereby generating large volumes of typically long paper trim that must be efficiently discarded. Most commonly, the paper trim is removed by a burster, trimmer, stacker assembly (BTS) disposed in line as part of the printing system and which actually cuts and removes the paper trim, including any perforations that may be provided in the paper. Accordingly, there is a need for a system which provides for the effective and efficient removal and disposal of that paper waste, including the paper trim and paper chad, from the printing system, especially when the printing system is a high speed, continuous operation printing system through which paper is being fed at a high rate of speed. Also, such a disposal system should be configured to permit the continuous operation of the printing system without the risk of paper waste obstructing or otherwise decreasing the effectiveness of the printing.

The present methods developed for the disposal of paper waste in such printing systems, and especially those utilizing a BTS, includes the positioning of a bin in cooperative proximity to the printing system such that the paper trim and paper chad may merely fall or be blown into the bin, and the bin can subsequently be emptied. Unfortunately, such methods take up a large amounts of space and require a constant interruption in the cutting and trimming process and constant interchanging of bins in order to empty the full bins into a conventional trash compactor assembly. This is especially the case because the paper waste when dumped into a large bin tends to maintain a generally loose or fluffy configuration that quickly takes up more space than the actual paper volume being contained. Further, while the bins are removed and emptied, paper waste continues to be generated and large volumes of spillage can result if the high speed cycle is not at least temporarily interrupted. Also, it is noted that the emptying of the paper trim and/or paper chad into large bins has a tendency to generate large quantities of dust in the printing environment. Not only are the large quantities of dust potentially harmful to personnel in the printing room, but also the dust can tend to damage or deteriorate the printing system and other expensive operating systems within the printing room including expensive ventilation systems. As such, in addition to requiring an effective manner of removing paper trim and paper chad without requiring a shut down of the printing system and without resulting in a large volume of spillage, it would also be beneficial to provide a system which is substantially well contained and minimizes the generation and spread of dust, both as a result of the paper waste trimming and collection and as a result of the printing itself.

In addition to the above noted bin collection structures now in the art, other systems incorporate the spooling or rolling of the paper trim into large spools that can be discarded as a unit. Unfortunately, most spooling systems also require a large amount of space in close proximity to the printing system, and necessarily require a temporary shut down of the printing system in order to remove the spool for disposal. Furthermore, such systems do not adequately address the removal of non-continuous paper trim, nor of paper chad as well as dust from the printing system.

Accordingly, from the proceeding it would be highly beneficial to provide a paper waste disposal system which is specially adapted for use with high speed, continuous operation printing systems, and is capable of removing all paper waste, including paper trim, paper chad and dust particles in an efficient manner which does not provide for the release of excessive dust particulate into the air, does not require a shut down of the system in order to provide paper disposal, and does not require and excessive amount of space in the immediate vicinity of the printer for proper operation.

SUMMARY OF THE INVENTION

The present invention relates to a paper waste disposal system particularly suited for use with a continuous feed and continuous operation printing system. Further, the paper waste disposal system of the present invention is structured to collect and provide for the disposal of a variety of types of paper waste, including paper trim, paper chad and dust, and includes an intake assembly. The intake assembly is operatively associated with the printing system, and may be disposed a spaced apart distance therefrom, so as to receive the paper waste generated by the printing system, and especially by the BTS of the printing system. Furthermore, the paper waste disposal system includes a collection assembly. The collection assembly is structured to collect and contain the paper waste that is received by the intake assembly into the paper waste disposal system of the present invention.

Interposed between the intake assembly and the collection assembly of the present invention is a disposal moderation assembly. In particular, the disposal moderation assembly is structured to continuously pass the paper waste received by the intake assembly to the collection assembly. The disposal moderation assembly, however, is also structured to control a rate of the continuous passage of the paper waste into the collection assembly thereby permitting removal of the paper waste contained by the collection assembly without requiring an interruption in the receipt of paper waste by the intake assembly. Accordingly, the operation of the printing system is not interrupted even though paper waste is continuously being accepted by the intake assembly. Still, however, the manner and rate at which the paper waste is passed into the collection assembly is such that removal and disposal of collected paper waste is substantially easy, is not required too frequently, and does not result in substantial spillage of paper waste during that disposal process.

It is an object of the present invention to provide a paper waste disposal system which does not require the interruption of operation of a printing system in order to provide for the effective disposal of a variety of types of paper waste being generated by the printing system.

A further object of the present invention is to provide a paper waste disposal system which is substantially self contained and does not result in the emission of dust and paper particulate into the environment.

Yet another object of the present invention is to provide a paper waste disposal system which substantially compresses and compacts paper waste so as to facilitate the disposal of large quantities of paper waste without taking up a large volume.

Another object of the present invention is to provide a paper waste disposal system which does not require the use of large, expensive commercial compactors, yet which provides for the effective disposal of paper waste in a compressed and easily disposed of manner.

An alternative object of the present invention is to provide a paper waste disposal system which can continuously operate with minimum risk of becoming of backed up or becoming otherwise hindered during the continuous operation of the printing system.

An added object of the present invention is to provide a paper waste disposal system which does not need to be principally disposed in the immediate vicinity of the printing system.

A further object of the present invention is to provide a paper waste disposal system which is self cooled and substantially self contained.

These and other objects would become apparent with the following detailed description taken in connection with following claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
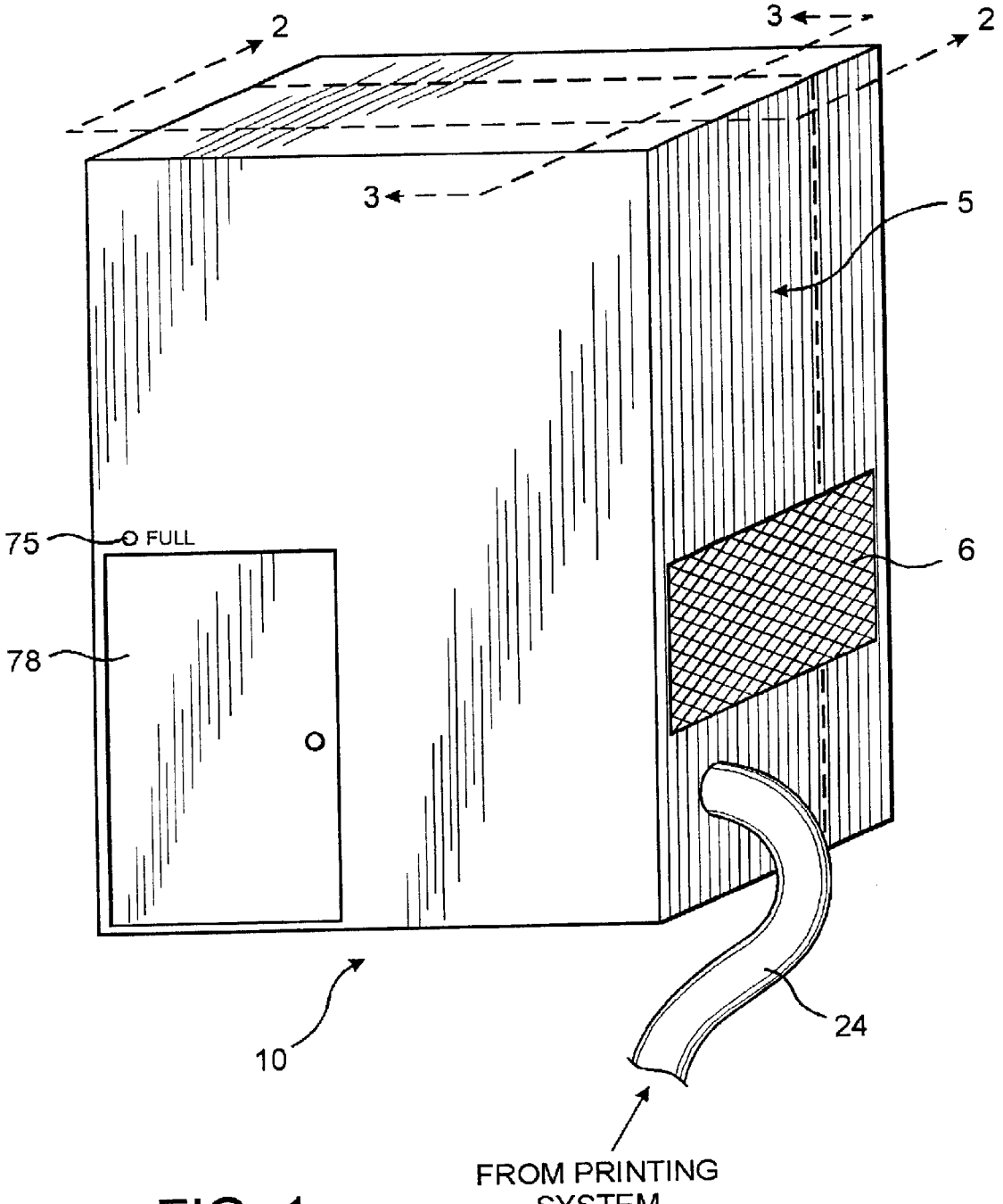
FIG. 1 is a perspective view of the paper waste disposal system of the present invention.
Figure 2:
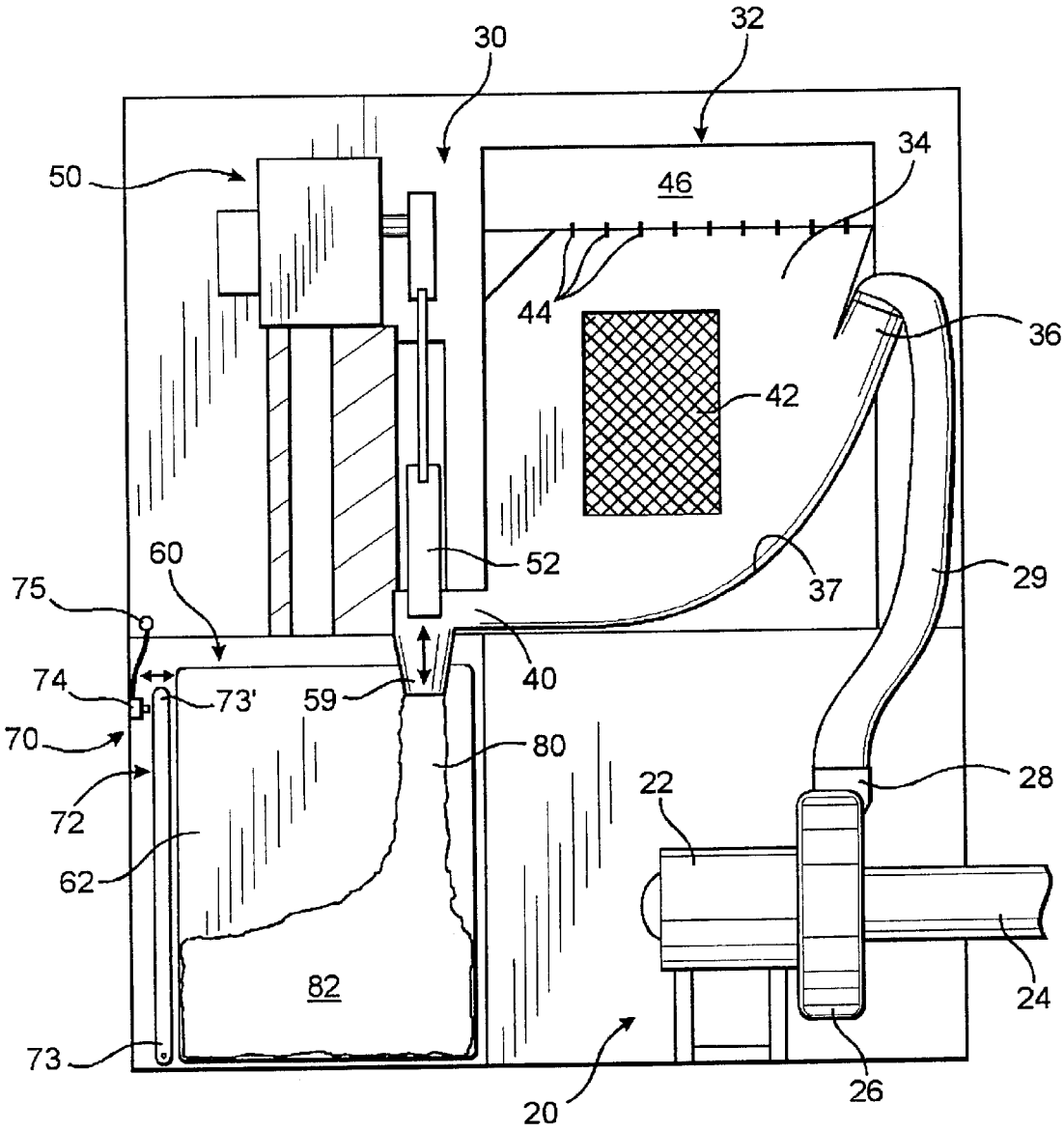
FIG. 2 is a cross section view of the paper waste disposal system of the present invention along line 2—2 of FIG. 1.
Figure 3:
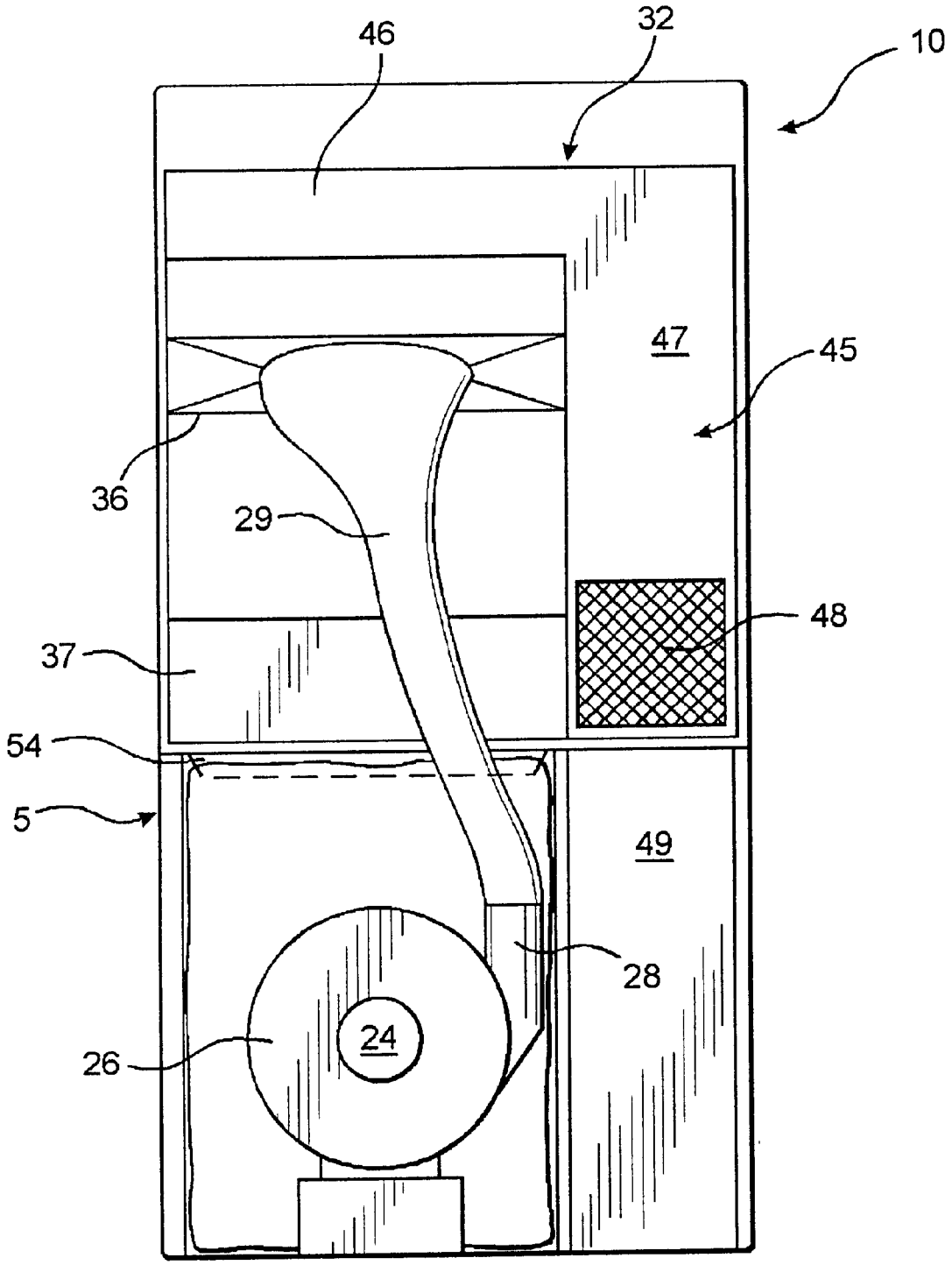
FIG. 3 is a cross section view of the paper waste disposal system of the present invention along line 3—3 of FIG. 1.

Shown throughout the Figures, the present invention is directed towards a paper waste disposal system, generally indicated as 10. The paper waste disposal system 10, which is preferably contained within a housing 5 so as to improve its aesthetics and generally muffle interior noise, is structured for use with a large high volume printing system, not shown herein for clarity. Specifically, the printing system is typically of the type that is utilized with larger computer systems and is structured to provide for the continuous feed of paper into the system and the continuous operation thereof in order to generate large volumes of paper. Moreover, the printing system is typically of the type which utilizes a continuous feed paper stream of the type having sheets attached by perforations and a track structure along opposite edges thereof which facilitates its threading through the printing system in a substantially continuous manner. Naturally, the track structure and/or the perforations are not to be maintained attached to the paper once the printed documents are ready for distribution, but rather are removed by a BTS or other similar structure. As a result, the printing system generally produces large volumes of paper waste, the paper waste including the paper trim which makes up the track structure and perforations between sheets of paper, as well as the paper chad which is removed to define holes in the track structure, and paper dust which may be generated therebetween and indeed is often present in some form in the continuous paper stream and a heavy duty printing environment.

The paper waste disposal system 10 includes an intake assembly, generally indicated as 20. In particular, the intake assembly 20 is disposed in operative association with the printing system so as to receive the paper waste generated by the printing system. In this regard, the preferred intake assembly 20 includes an intake conduit 24 which extends to the printing system itself. Not completely shown for purposes of clarity, the intake conduit 24 may include one or a plurality of openings disposed relative to the printing system such that the paper trim, paper chad and paper dust can easily enter the intake conduit 24. Furthermore, in the preferred embodiment the intake assembly includes a vacuum source 22. As a result, the vacuum source 22 creates a suction at the intake conduit 24 and draws or sucks in the paper waste that is generated by the printing system. In this regard, the intake conduit 24 can include one or a number of individual tubes disposed in a vacuum type orientation relative to an outlet for the paper waste at one or more locations, including inlet, intermediary and outlet locations, of the printing system. For example, one or more conduits may be provided at the BTS of the printing system so as to draw in the paper trim that is cut from the printed paper documents. Regardless of the location, the vacuum source 22 is structured to generate sufficient vacuum so as to draw the paper waste into the intake conduit 24. Also, if desired, the housing 5 can be disposed a spaced apart and out of the way distance from the printing system itself, with only the intake conduit 24 extending to the printing system. As such, the paper waste disposal system 10 need not hamper or otherwise obstruct the normal operation of the printing system and workers in its environment.

Further preferably included as part of the intake assembly 20 of the paper waste disposal system 10 is a chopper 26. Specifically, the chopper 26 may include a large fan blade or a plurality of turbine type blades that engage the paper waste being drawn in and which also preferably function to actually generate the vacuum, upon being powered and rotated by the vacuum source 22, which draws the paper waste therein through the intake conduit 24. The chopper 26 is structured to continuously operate to reduce the size, such as the length, of the paper waste, and especially the continuous paper trim, by chopping it into much smaller pieces. As a result, although not absolutely required, a preferred chopper 26 facilitates the passage of the paper waste through the remainder of the paper waste disposal system 10, as is to be described subsequently, and the increased containment of large volumes of paper waste therein.

Also in the preferred embodiment of the intake assembly 20, the chopper 26 generally provides a central point of the intake assembly 20 in that the vacuum is drawn into intake conduit 24 and into the chopper 26, however, the exhaust air as a result of the generation of the vacuum is blown out a vacuum outlet 28. The vacuum outlet 28 is structured to receive exhaust air and paper waste therethrough. Specifically, the paper waste is contained in the air being drawn in, and as a result, upon blowing the exhaust air out of the outlet 28, this also functions to blow the paper waste out of the through outlet 28 into a conduit 29 with a certain degree of force. Accordingly, in the preferred intake assembly 20, the paper waste is drawn into a conduit 24, passes through the preferred chopper 26 and is blown out through the outlet 28 into the conduit 29 for further processing by the paper waste disposal system 10 of the present invention.

The paper waste disposal system 10 further includes a disposal moderation assembly, generally indicated as 30. The disposal moderation assembly 30 is structured to continuously pass the paper waste received by the intake assembly 20 through the paper waste disposal system 10 while controlling a rate of that passage. In particular, the disposal moderation assembly 30 of the preferred embodiment tends to stagger the rate at which paper waste enters a collection assembly 60, to be described in greater detail subsequently, such that the regardless of the continuous operation of the printing system and continuous generation of paper waste, the paper waste contained by the collection assembly 60 can be removed and disposed of without having to interrupt the receipt of paper waste by the intake assembly 20 and accordingly the operation of the printing system. Furthermore, the disposal moderation assembly 30 permits the continuous operation of the printing system in a manner which substantially maintains confinement in the manner of disposal of the paper waste to be achieved by the paper waste disposal system 10.

Looking in further detail to the disposal moderation assembly 30, it preferably includes a circulation chamber 32. The circulation chamber 32 is structured to receive the paper waste passing through conduit 29 from the intake assembly 20 therein, under a blowing force generated by the vacuum source 22. In this regard the circulation chamber 32 includes at least one inlet 36. The inlet 36, which is preferably generally elongate is preferably coupled in a generally sealed manner with the conduit 29 such that all of the paper waste is blown through the inlet 36 and into an interior 34 of the circulation chamber 32.

The circulation chamber 32 also includes at least one outlet 40. The outlet 40 is structured to provide communicative access for the passage of the paper waste into a compression assembly 50 for subsequent disposal. Along these lines the inlet 36 of a circulation chamber 32 preferably is structured so as to generally direct the paper waste that is being blown therethrough generally towards the outlet 40. As a result, in the preferred embodiment, the inlet 36 includes a generally sloped surface 37, such that the paper waste blown through the inlet 36 is generally directed towards the outlet 40. It is noted, however, that the outlet 40 is preferably of a limited size such that not all of the paper waste blown in through the inlet 36 will immediately pass through the outlet 40 into the compression assembly 50. Rather, the construction of the circulation chamber 32 is such that paper waste that does not pass through the outlet 40 for compression within a given compression cycle of the compression assembly 50 tends to be circulated through the open interior 34 of the circulation chamber 32. For example, as the outlet 40 tends to become backed up and is gradually relieved by continuous compression cycles performed by the compression assembly 50, the portion of the paper waste that can not pass through the outlet 40 for a given compression cycle is blown in a preferably circulating manner as a result of the blowing inlet force which introduces the paper waste into the circulation chamber 32. Moreover, the air flow through the circulation chamber 32 is preferably only sufficient to maintain the paper waste circulating through the interior 34 of the circulation chamber 32, and must be released. To this end, at least one and preferably a plurality of exhaust apertures are provided so as to relieve the blowing pressure from within the circulation chamber 32. In the preferred embodiment, a vent structure 42 is preferably disposed in a wall of the circulation chamber 32 to define one or more exhaust apertures, and preferably a plurality of individual apertures 44 are further disposed in an upper portion of the circulation chamber 32. Regardless, however, the one or more exhaust apertures 42, 44 function to relieve the blowing pressure such that the paper waste does not tend to get pinned against the exhaust apertures 42, 44 or the surface of the circulation chamber 32 as a result of the continuous air flow through the exhaust apertures, but rather is such that the paper waste will generally circulate and will fall back down towards the sloped surface 37 for repeated urging by the paper waste being blown in through the inlet 36 towards the outlet 40. The relieved blowing pressure and in particular the exhaust air that relieves the blowing pressure is preferably directed from the exhaust apertures 42, 44 into a ventilation system 45, to be described in greater detailed subsequently.

Figure 4:
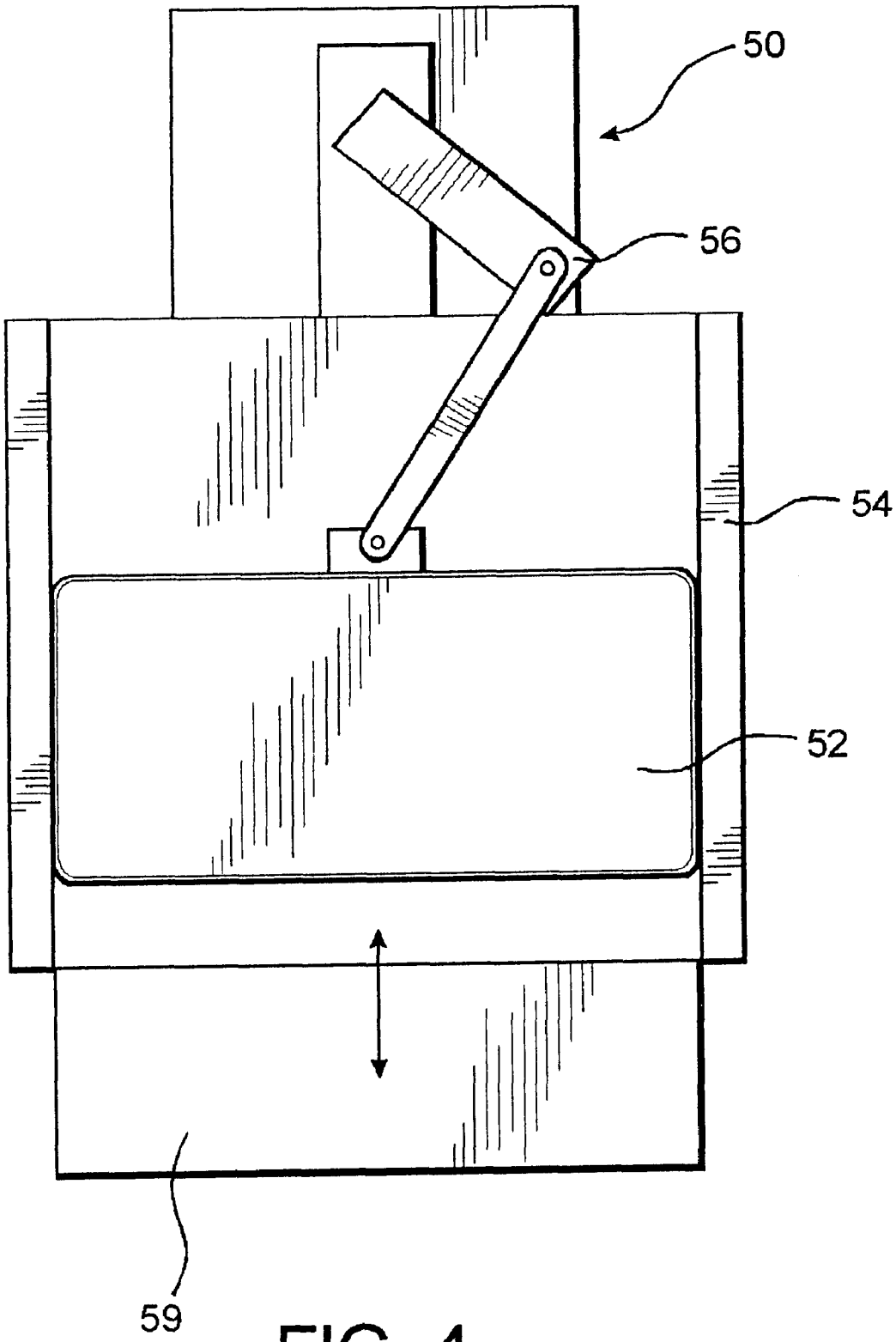
FIG. 4 is an isolated front plan view of the compression assembly of the disposal moderation assembly of the present invention.

As indicated the outlet 40 of the circulation chamber 32 is disposed in operative communication with a compression assembly 50. The compression assembly 50, which continuously performs compression cycles that compress and move the paper waste for subsequent disposal, preferably includes a piston like compression panel 52. The compression panel 52 is preferably structured to ride within a track assembly 54, and utilizing a conventional linkage 56 is structured to ride up and down within the track 54, as best illustrated in FIG. 4. Furthermore, the compression panel 52 is structured to compress the paper waste into a compression funnel 59. In particular, the compression funnel 59 includes a tapered configuration so as to generally restrict a quantity of the paper waste that can be compressed therein and pushed therethrough in a particular compression cycle for passage through to the collection assembly 60. As seen in the Figures, an inlet of the compression funnel is preferably restricted and the funnel 59 tapers down to approximately a dimension of the compression panel 52, such that only a limited amount of paper waste is compressed within the compression funnel 59 itself and is simultaneously urged into the collection assembly 60 as a result of that compression. Indeed, it is the restriction of passage into the collection assembly 60 as provided by the compression funnel 59 that provides an opposing force against which the compression panel 52 can generally compress the paper waste. As such, it is seen that during each compression cycle by the compression panel 52, paper waste is urged through the outlet 40 of the circulation chamber 32 and into an area beneath the compression panel 52 for compression into the compression funnel 59. This urging or pushing through the funnel 59 is essentially simultaneous with the compression and as a result only a gradual passage of paper waste through the funnel 59 results.

Once it is pushed through the compression funnel 59, the paper waste generally tends to be urged in a column 80 into the collection assembly 60. This column 80, which terminates in the main body 82 of the compressed paper waste also functions to oppose the compression by the compression panel 52 and increase a compression of the paper waste, until such a point as a maximum quantity of paper waste is compressed into the column 80, and the column 80 tends to collapse to further enlarge the main body 82 of the compressed paper within the collection assembly 60. This process continues until the collection assembly 60 in emptied, as will be described.

The collection assembly 60 is disposed in paper waste receiving communication with the disposal of moderation assembly 30, and especially with the compression funnel 59 of the compression assembly 50 so as to receive therein the paper waste that is being drawn into the paper waste disposal system 10 by the intake assembly 20. The collection assembly 60 preferably defines a generally large area into which a substantial quantity of compressed paper waste can be collected over a given period of time. Furthermore, the collection assembly 60 also preferably includes a disposal chamber 62 defined therein. The disposal chamber 62 is preferably removable and exteriorly accessible and is also in paper waste receiving communication with the disposal moderation assembly 30 such that all of the compressed paper waste is introduced into disposal chamber 62. In this regard, the disposal chamber 62 may include a flexible material container, such as a bag or like structure with or without a rigid framing structure, or a rigid container, such as a removable rigid walled chamber. In either instance, however, the housing 5 of the paper waste disposal system 10, preferably includes an exterior hatch or opening, which in the preferred embodiment is enclosed by a door 78 which is opened so as to permit the exterior access to the disposal chamber 62 and subsequent removal of the disposal chamber 62 for discarding of the paper waste contained therein. Significantly, as indicated previously, however, paper waste emerges from the compression funnel 59 quite gradually as the rate is restricted thereby. As a result, when the disposal chamber 62 is full, it can be easily removed and the paper waste contained therein disposed of in a conventional trash bin while minimal if any paper waste emerges from the compression funnel 59 until it is replaced. Accordingly, the operation of the printing system can continue as the large and rapid quantities of paper waste are being processed throughout the disposal moderation assembly 30 and a restricted rate of flow actually is directed into the disposal chamber 62.

As an added benefit, the collection assembly 60 preferably includes a level indicator 70 structured and disposed to prompt a removal of the paper waste from the disposal chamber 62 when the paper waste has reached a certain level set by the user or manufacturer. In the preferred embodiment, the level indicator 70 includes a displaceable panel 72 pivotally disposed with and preferably within the collection assembly 60. The displaceable panel 72 is pivotally secured at generally a bottom end 73 thereof such that outward pivoting results primarily at generally an upper end 73' of the displaceable panel 72. In this regard, a switch structure is preferably positioned in proximity with the upper end 73' of the displaceable panel 72, such that when the upper end 73' of the displaceable panel 72 has been displaced a sufficient distance, it engages the switch 74 triggering an exteriorly discernable signal 75. This exteriorly discernable signal 75, which can be a visual indicator, audio indicator, or a combination thereof provides notice to a user that the disposal chamber 62 should be removed and the paper waste contained therein should be discarded. Looking further to the operation of the displaceable panel 72, however, because the paper waste emerges from the compression funnel 59 in the column 80, the body 82 of compressed paper waste only increases at a gradual rate as the paper waste is actually secondarily compressed within the disposal chamber 62, thereby maximizing an amount of paper waste that could be contained in the disposal chamber 62. As, however, the level of the main body 82 of the compressed paper waste increases because the column 80 has collapsed a sufficient number of times, an outward pressure is exerted on the walls of the compression assembly 60, and in particular on the displaceable panel 72. Although at first that outward pressure exerted by the compressed paper waste is concentrated at lower portion of the displaceable panel 72, such that a substantial outward displacement of the upper end 73' of the displaceable panel 72 does not result, as the level of paper waste increases, the outward pressure is concentrated closer to the upper end 73' of the displaceable panel 72 until eventually the switch 74 is triggered. Accordingly, this structure maximizes the amount of paper waste that can be contained before removal is triggered, and indeed ensures that the paper waste is not collected in a loose manner within the disposal chamber 62, but rather that the paper waste is compressed and maximum quantities of paper waste 82 are being contained so as to minimize the frequency of required, removals and emptying out of the disposal chamber 62.

Looking once again to the circulation chamber 32, and in particular to the preferred plurality of exhaust apertures 42 and 44, they are preferably communicatively disposed with a ventilation system 45. In particular, the ventilation system 45 includes an upper air return chamber 46 into which exhaust air passing through the exhaust apertures 44 flows, and a side chamber 47 through which the air passing through the side vent structure exhaust aperture 42 flows. From the ventilation chambers 46 and 47, the exhaust passes through a preferred vent structure 48 and is directed into the interior of the housing 5. Although a filtration screen structure 6 is preferably disposed in the housing 5 so as to allow for the ultimate exit of exhaust air from the housing 5 of the paper waste disposal system 10 in a filtered manner, the precise positioning of the filtration screen structure 6 can be varied depending upon the needs of the paper waste disposal system 10. Furthermore, it is preferred that the exhaust air be cycled and circulated throughout the housing 5 so as to generally cool the compression assembly 50 and the intake assembly 20. In this regard, it is noted that a generally open interior configuration is provided within the housing 10 such that air that emerges from the circulation chamber 32, is passed down through an open area into cooling association with the intake assembly 20, as well as behind the collection assembly 60 for upward cooling passage towards the compression assembly 50. Of course, it is noted that as to the preferred cooling, any means of circulating the exhaust air through the housing 10 can be equally effective, including the inclusion of additional outlet apertures within the circulation chamber 32 so as to direct exhaust air more directly towards the compression assembly 50 and the intake assembly 20.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. To be used with a continuous feed/continuous operation printing system, a paper waste disposal system comprising:

an intake assembly disposed in operative association with the printing system and structured to continuously receive paper waste generated by the printing system;

said intake assembly including a chopper structured to reduce a size of the continuous intake of paper waste;

a collection assembly structured to continuously collect and contain the paper waste received by said intake assembly;

a disposal moderation assembly structured to continuously pass the paper waste received by said intake assembly to said collection assembly and to control a rate of the continuous passage thereof into said collection assembly so as permit removal of the paper waste contained by said collection assembly without requiring an interruption in the receipt of the paper waste by the intake assembly and accordingly the operation of the printing system;

said disposal moderation assembly including a compression assembly structured to compress the paper waste for deposit into said collection assembly; and said disposal moderation assembly further including a circulation chamber disposed in paper flow communication with said intake assembly and structured to continuously circulate, separate and contain at least a portion of the paper waste therein until compressed by said compression assembly so as to allow the paper waste to be continuously drawn in and minimize compression hindering gathering of the paper waste.

2. A paper waste disposal system as recited in claim 1 wherein said intake assembly includes a vacuum source structured to draw in the paper waste being generated by the printing system.

3. A paper waste disposal system as recited in claim 1 wherein said intake assembly is structured to draw in the paper waste generated by the printing system and to subsequently blow the paper waste into said disposal moderation assembly.

4. A paper waste disposal system as recited in claim 1 wherein said collection assembly includes a removable and exteriorly accessible disposal chamber disposed in paper waste receiving communication with said disposal moderation assembly.

5. A paper waste disposal system as recited in claim 4 wherein said disposal chamber includes a flexible material container.

6. A paper waste disposal system as recited in claim 4 wherein said disposal chamber includes a rigid container.

7. A paper waste disposal system as recited in claim 4 wherein said collection assembly includes a level indicator structured and disposed to prompt a removal of paper waste from said disposal chamber.

8. A paper waste disposal system as recited in claim 7 wherein said level indicator comprises a displaceable panel pivotally disposed with said collection assembly.

9. A paper waste disposal system as recited in claim 8 wherein said displaceable panel is pivotally secured at generally a bottom edge thereof such that outward displacement thereof results upon said disposal chamber becoming filled with said paper waste to a predetermined level.

10. A paper waste disposal system as recited in claim 7 wherein said disposal moderation assembly is structured to compress said paper waste into said disposal chamber so as to exert an outward pivoting force upon said displaceable panel.

11. A paper waste disposal system as recited in claim 10 wherein said level indicator includes an exteriorly discernable signal structured to be triggered upon said displaceable panel being pivotally displaced a predetermined distance.

12. A paper waste disposal system as recited in claim 1 wherein said intake assembly is structured to blow the paper waste into said disposal moderation assembly.

13. A paper waste disposal system as recited in claim 12 wherein said circulation chamber includes at least one inlet and at least one outlet.

14. A paper waste disposal system as recited in claim 13 wherein said outlet of said circulation chamber is disposed in paper waste passage communication with said compression assembly.

15. A paper waste disposal system as recited in claim 13 wherein said inlet of said circulation chamber is structured to direct the paper waste passing therethrough generally to said outlet.

16. A paper waste disposal system as recited in claim 13 wherein said compression assembly is structured to continuously perform compression cycles, and is structured such that each of said compression cycles passes a limited quantity of the paper waste into said collection assembly.

17. A paper waste disposal system as recited in claim 16 wherein said compression assembly includes a compression funnel which restricts a quantity of the paper waste that can be compressed in a particular compression cycle into said collection assembly.

18. A paper waste disposal system as recited in claim 16 wherein said compression assembly and said circulation chamber are cooperatively disposed with one another such that at least a portion of the paper waste directed to said outlet for passage into said compression assembly which does not get passed into said collection assembly during one of said compression cycles is circulated through said circulation chamber for subsequent direction to said outlet.

19. A paper waste disposal system as recited in claim 18 wherein a blowing pressure generated by said intake assembly for blowing the paper waste into said circulation chamber is sufficient to circulate said portion of the paper waste through said circulation chamber.

20. A paper waste disposal system as recited in claim 19 wherein said circulation chamber includes at least one exhaust aperture through which air being blown by said intake assembly through said circulation chamber can exit said circulation chamber, thereby relieving an air pressure within said circulation chamber and permitting return of the waste paper towards said outlet of said circulation chamber.

21. A paper waste disposal system as recited in claim 20 including a plurality of said exhaust apertures.

22. A paper waste disposal system as recited in claim 20 wherein said plurality of exhaust apertures are communicably disposed with a ventilation system, said ventilation system structured and disposed to circulate said air exiting said circulation chamber to at least partially cool the paper waste disposal system.

23. A paper waste disposal system as recited in claim 22 wherein said ventilation system is structured to cool said intake assembly.

24. A paper waste disposal system as recited in claim 22 wherein said ventilation system is structured to cool said compression assembly.

25. A paper waste disposal system as recited in claim 22 further comprising a housing, said housing containing said intake assembly, said collection assembly, and said disposal moderation assembly.

26. A paper waste disposal system as recited in claim 25 wherein said housing includes an opening operatively associated with said intake assembly and an exhaust through which the air circulated by said ventilation system exits said housing.

27. A paper waste disposal system as recited in claim 25 wherein said housing includes an access hatch structured and disposed to permit exterior access to said collection assembly so as to facilitate disposal of the paper waste contained therein.

* * * * *